US011873843B2

(12) United States Patent
Hilden et al.

(10) Patent No.: US 11,873,843 B2
(45) Date of Patent: Jan. 16, 2024

(54) PUMP PROPELLER GUARD

(71) Applicant: Kasco Marine, Inc., Prescott, WI (US)

(72) Inventors: Travis Hilden, Prescott, WI (US); David Decaire, Prescott, WI (US); Todd Dombrock, Prescott, WI (US); Zach Whetstone, Prescott, WI (US); Chad Attlesey, Prescott, WI (US); James Verdouw, Prescott, WI (US); Trevor Johnson, Prescott, WI (US)

(73) Assignee: KASCO MARINE, INC., Prescott, WI (US)

( * ) Notice: Subject to any disclaimer, the term of this patent is extended or adjusted under 35 U.S.C. 154(b) by 92 days.

(21) Appl. No.: 17/308,248

(22) Filed: May 5, 2021

(65) Prior Publication Data

US 2021/0348626 A1 Nov. 11, 2021

Related U.S. Application Data

(60) Provisional application No. 63/021,240, filed on May 7, 2020.

(51) Int. Cl.

| | |
|---|---|
| ***F04D 29/70*** | (2006.01) |
| ***F04D 29/18*** | (2006.01) |
| ***F04D 29/043*** | (2006.01) |
| ***F04D 3/00*** | (2006.01) |

(52) U.S. Cl.

CPC ..... *F04D 29/708* (2013.01); *F04D 3/00* (2013.01); *F04D 29/043* (2013.01); *F04D 29/181* (2013.01)

(58) Field of Classification Search

CPC .... F04D 29/703; F04D 29/708; F04D 29/181; F04D 3/00; B63H 11/08; B63H 2011/081

See application file for complete search history.

(56) References Cited

U.S. PATENT DOCUMENTS

| | | | | | |
|---|---|---|---|---|---|
| 2,723,641 | A * | 11/1955 | Taylor | B63H 5/165 | 416/247 R |
| 3,075,491 | A * | 1/1963 | Hogan | B63H 5/165 | 416/247 R |
| 3,402,882 | A * | 9/1968 | Militello | F04D 29/703 | 415/121.2 |
| 4,461,614 | A * | 7/1984 | Niedermeyer | F04D 29/061 | 415/173.1 |
| 6,692,240 | B1 * | 2/2004 | Leonhard | F04B 39/066 | 417/372 |
| 8,961,249 | B2 * | 2/2015 | Stearn | B63H 5/165 | 440/71 |
| 2016/0265537 | A1 * | 9/2016 | Dane | F04D 29/181 | |
| 2022/0297075 | A1 * | 9/2022 | Johnson | F16M 13/02 | |

* cited by examiner

*Primary Examiner* — David E Sosnowski
*Assistant Examiner* — Jackson N Gillenwaters
(74) *Attorney, Agent, or Firm* — Hamre, Schumann, Mueller & Larson, P.C.

(57) ABSTRACT

An improved guard for a pump propeller is described herein. The guard includes a hub that in use surrounds a drive shaft of a drive motor unit that drives the propeller. The vanes define a propeller receiving area in which the propeller is received allowing the propeller to rotate relative to the vanes, while portions of the vanes radially surround the propeller. The guard is fixed in position about the propeller to protect the propeller from debris and to prevent human contact with the rotating propeller. The guard is designed to shed weeds and other debris, and prevent weeds and other debris from becoming entangled on the guard and with the propeller.

17 Claims, 5 Drawing Sheets

PUMP PROPELLER GUARD

FIELD

This technical disclosure relates to a guard for a pump propeller that is configured to protect the propeller from debris and human contact.

BACKGROUND

The use of a guard that is mounted around a pump propeller to protect against debris and human contact with the propeller is known. One example of a guard is used on a de-icer water agitator pump, a circulation pump, a mixing pump, and an aeration pump each of which is available from Kasco Marine of Prescott, Wisconsin.

SUMMARY

An improved guard for a pump propeller is described herein. The guard is fixed in position about the propeller to protect the propeller from debris and to prevent human contact with the rotating propeller. The guard is designed to shed weeds and other debris, and prevent weeds and other debris from becoming entangled on the guard and with the propeller and motor drive shaft.

In one embodiment, the guard can be an integrally formed one-piece construction of plastic including a center hub and a plurality of fixed, stationary vanes disposed about the hub. However, the guard can be formed of materials other than plastic, and the guard need not be an integrally formed one-piece construction. The hub is configured to be mounted so as to surround a drive shaft of a motor that drives the propeller. The vanes define a propeller receiving area in which the propeller is received allowing the propeller to rotate relative to the vanes, while portions of the vanes radially surround the propeller.

One non-limiting example of a type of pump that the guard can be used on is a de-icer water agitator pump, and the pump propeller can be configured as an axial flow propeller. However, the guard can be used on other types of pumps that use rotating propellers that need to be protected by a propeller guard.

In one embodiment, a propeller guard described herein can include a center hub having a first end, a second end, and an outer surface extending from the first end to the second end. The center hub extends longitudinally from the first end to the second end. The guard includes a plurality of vanes with each vane having a radially inner end attached to the outer surface of the center hub, a radially outward facing edge spaced a distance from the center hub, a top edge, a bottom, a first side surface and a second side surface. The vanes may be equally circumferentially spaced from each other about the center hub, and the vanes are not directly attached to each other at their radially outward facing edges.

In one embodiment, a propeller guard described herein can include a center hub having a first end, a second end, and an outer surface extending from the first end to the second end. The center hub extends longitudinally from the first end to the second end. In addition, a plurality of fixed guide vanes extending radially from the center hub, with each fixed guide vane having a radially inner end attached to the outer surface of the center hub, a radially outward facing edge spaced a distance from the center hub, a top edge, a bottom, a first side surface and a second side surface. The vanes are circumferentially spaced from each other about the center hub, and the vanes are not directly attached to each other at their radially outward facing edges. A base plate is fixed to the second end of the center hub and the bottom of each vane is attached to the base plate. In addition, for each vane, a longitudinal length at the radially outward facing edge is greater than a longitudinal length at the radially inner end.

A pump described herein includes a drive motor unit with a rotatable drive shaft, a propeller fixed to the rotatable drive shaft, and the propeller guard described herein, with portions of the vanes of the propeller guard radially surrounding the propeller. In one embodiment, the guard can be a structure that is separate from the drive motor unit and is fastened to the drive motor housing around the propeller. In another embodiment, the guard can be integrally formed as a one-piece construction with the drive motor housing. In another embodiment, the pump can include an impeller and the guard is configured to surround the impeller.

DRAWINGS

DETAILED DESCRIPTION

Figure 1:
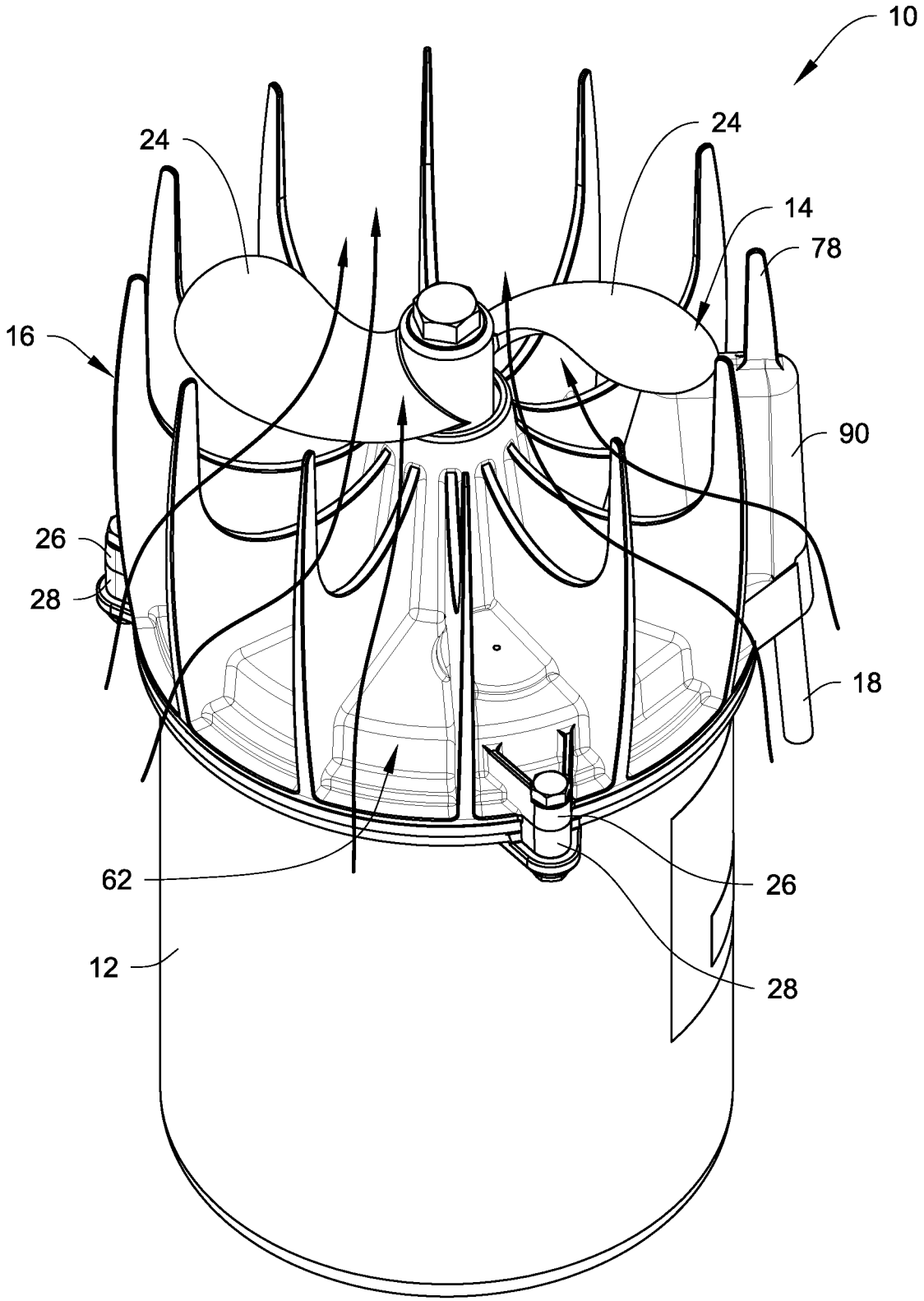
FIG. 1 illustrates an example of a pump with a propeller guard described herein on the pump.
Figure 3:
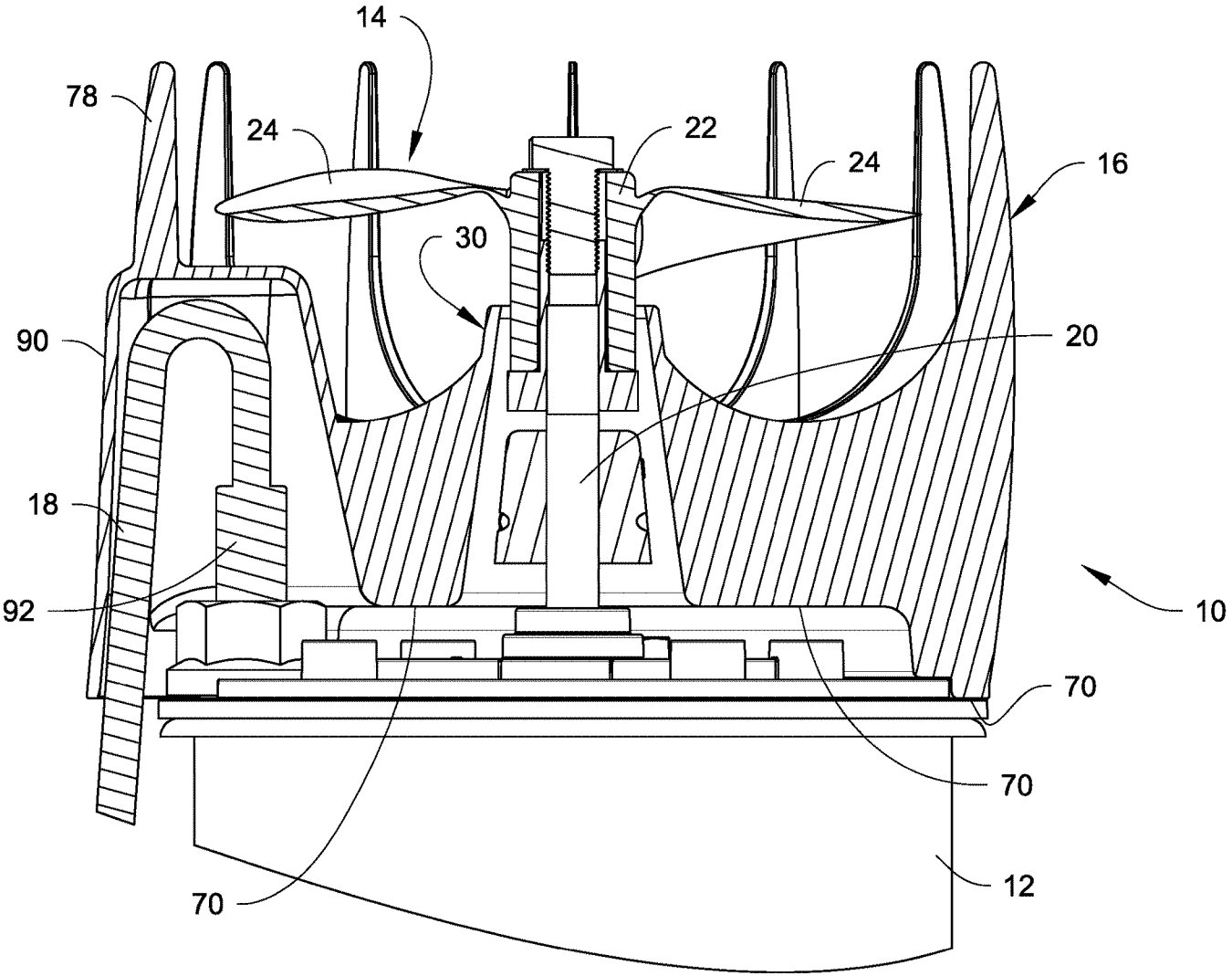
FIG. 3 is a cross-sectional side view of the propeller guard and the propeller of the pump.

Referring to FIGS. 1 and 3, an example of a pump 10 is illustrated. The pump 10 includes an electric drive motor unit 12, a propeller 14, and a propeller guard 16. The pump 10 can be used in any application in which a fluid needs to be pumped. Examples include, but are not limited to, circulating water to remove weeds and debris from locations such as marinas, areas around docks, and waterfront; treatment tanks for water and chemicals for mixing the contents to keep solids and chemicals in suspension and evenly distributed; and circulating water so that the water does not freeze within the vicinity of the pump 10. However, other applications of the pump 10 are possible. Electricity for powering the drive motor unit 12 is provided via an electrical cord 18 that suitably interfaces with the drive motor unit 12. The electrical cord 18 can connect at an opposite end to a source of electrical energy such as mains electrical power or to an electrical generator.

As best seen in FIG. 3, the drive motor unit 12 includes a drive shaft 20 that is rotated by a drive motor of the drive motor unit 12. The propeller 14 is fixed to and rotated by the drive shaft 20. The propeller 14 can have any configuration that is suitable for moving fluid when the propeller 14 rotates. In the illustrated example, the propeller 14 is configured as an axial flow propeller. Referring to FIGS. 1 and 3, the propeller 14 includes a hub 22 disposed around the shaft 20, and a plurality of propeller blades 24, for example two blades, fixed to the hub 22. However, the propeller 14 can have other configurations. FIG. 1 includes arrows which depict the flow of fluid, for example water, generated by the pump 10.

The propeller guard 16 is fixed to the pump 10 and protects the propeller 14. Referring to FIG. 1, the guard 16 can include a plurality of bosses 26 (two of which are visible in FIG. 1) which interface with bosses 28 on the drive motor unit 12, and screws connect to the bosses 26, 28 to removably mount the guard 16 to the drive motor unit 12. In another embodiment, the guard 16 can be integrally formed as a one-piece construction with the drive motor unit 12.

With reference to FIGS. 1-5, the guard 16 comprises a center hub 30 and a plurality of guide vanes 32. The hub 30 has a first end 34, a second end 36, an outer surface 38 extending from the first end 34 to the second end 36, and an inner surface 40 defining a central passage 42. The center hub 30 extends longitudinally from the first end 34 to the second end 36 so that the hub 30 has a longitudinal length LH (best seen in FIG. 5). In the illustrated embodiment, the hub 30 is shown as being conical in shape with the outer surface 38 sloping outwardly and increasing in width from the first end 34 to the second end 36. The inner surface 40 is also depicted as being sloped outwardly so that the central passage 42 increases in width from the first end 34 to the second end 36. However, the hub 30 can have other shapes.

As best seen in FIG. 3, in use with the guard 16 mounted in position, the hub 30 covers a portion of the hub 22 of the propeller 14. In addition, the hub 30 covers the remainder of the shaft 20 that is not covered by the propeller hub 22. Therefore, the shaft 20 is completely covered and protected by the hub 22 and the hub 30.

The guide vanes 32 are fixed in position around the hub 30 so that the vanes 32 are stationary and not adjustable. The vanes 32 can extend substantially radially from the hub 30, and the vanes 32 are circumferentially spaced from each other about the hub 30. In one embodiment, the vanes 32 can be equally circumferentially spaced from each other.

Figure 2:
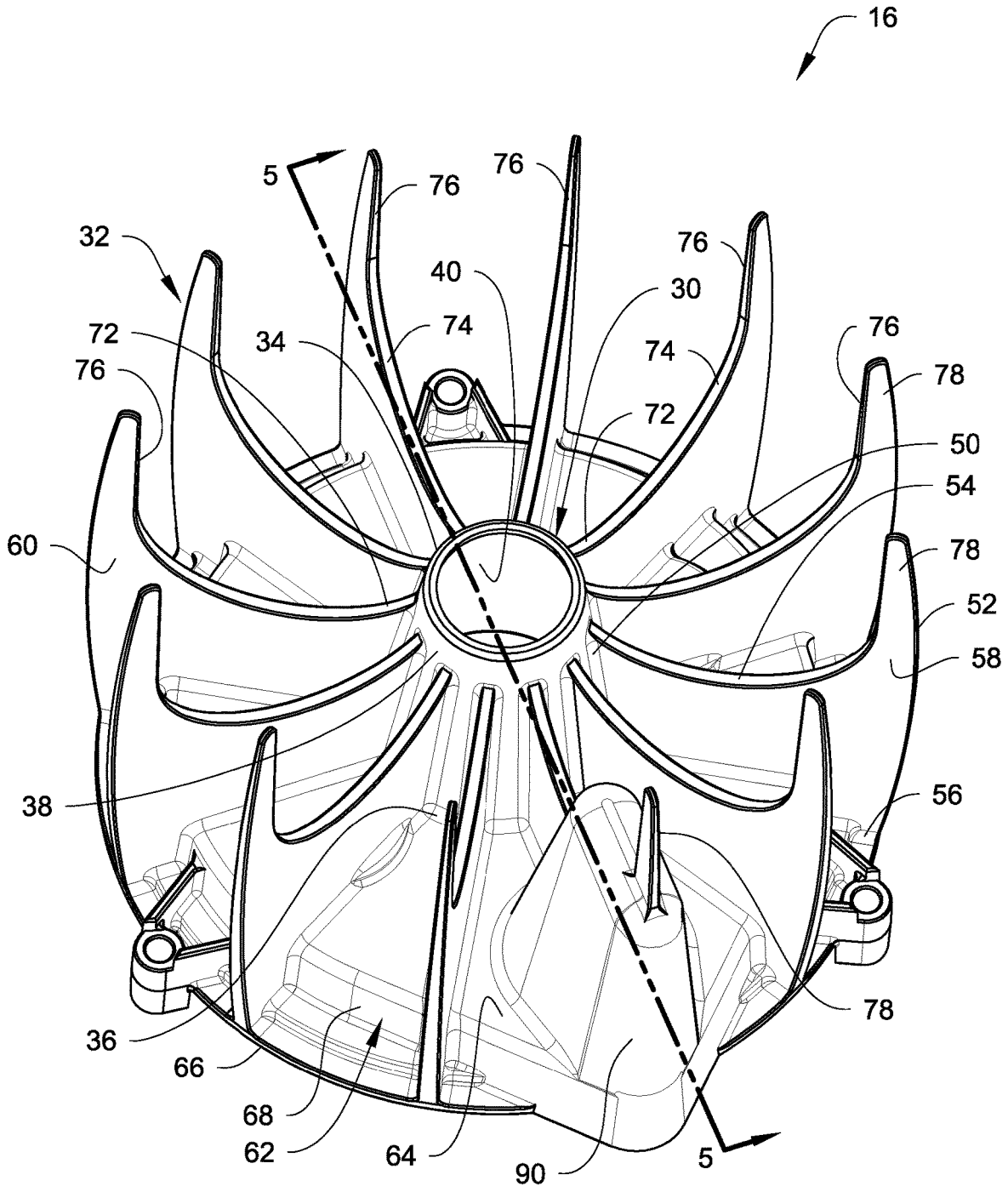
FIG. 2 is a perspective view of the propeller guard described herein.

Referring to FIG. 2, each guide vane 32 is substantially plate shaped with a radially inner end 50 attached to the outer surface 38 of the center hub 30, a radially outward facing edge 52 spaced a distance from the center hub 30, a top edge 54, a bottom 56, a first side surface 58 facing in a first direction and a second side surface 60 opposite the first side surface 58 and facing in an opposite, second direction. In one embodiment, both the first side surface 58 and the second side surface 60 can be substantially planar, and are parallel to one another.

Figure 4:
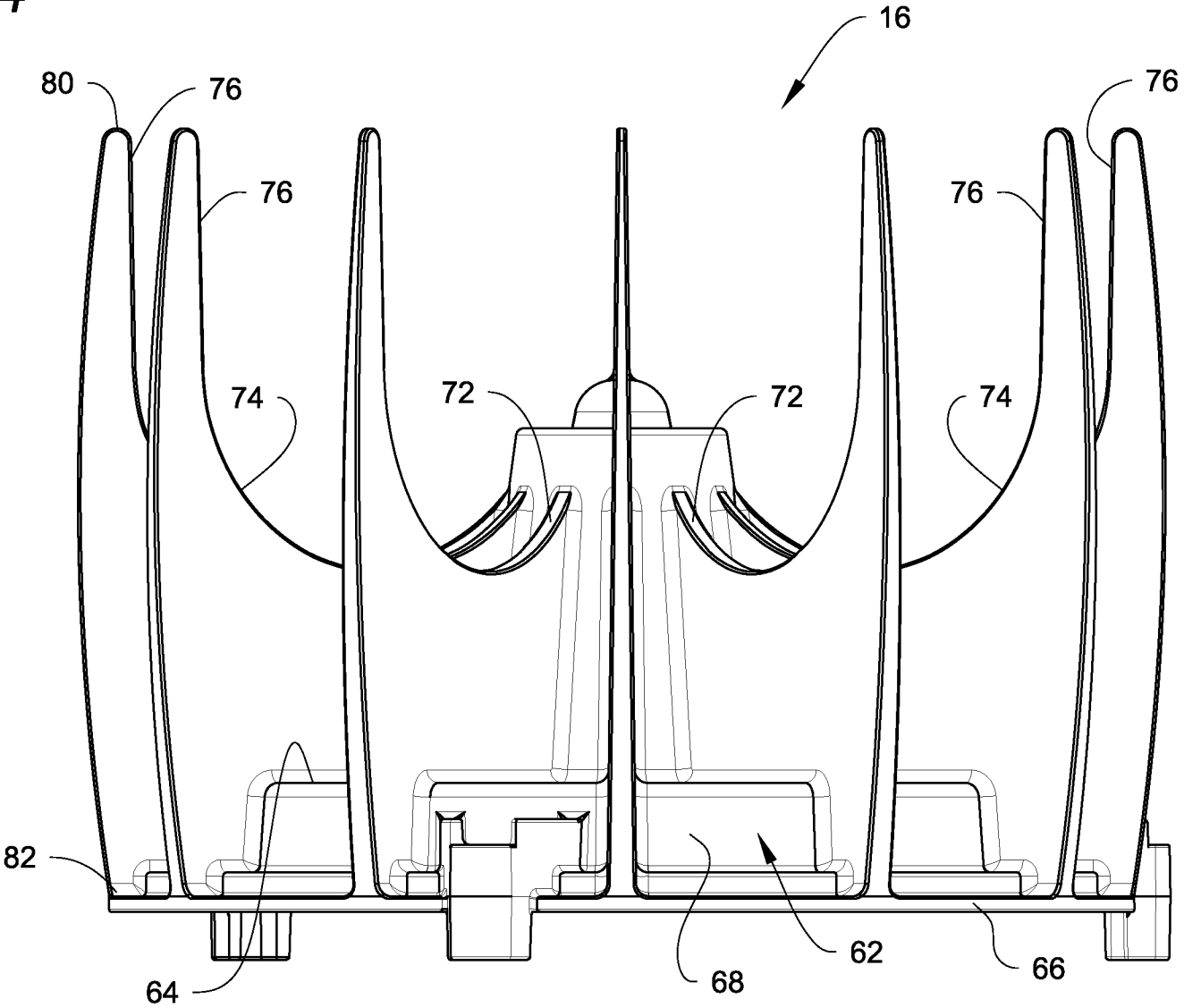
FIG. 4 is a side view of the propeller guard.

With reference to FIGS. 1-3, the guard 16 can also include a base plate 62, and the bottom 56 of each vane 32 is attached to the base plate 62. The base plate 62 can be solid, i.e. without openings, holes or fluid passages for fluid. However, in some embodiments, the base plate 62 can be apertured between each vane 32. The base plate 62 includes an upper portion 64, a perimeter edge portion 66, and a transition portion 68 that connects the upper portion 64 to the edge portion 66. As best seen in FIGS. 2-4, the base plate 62 is dished upwardly with the upper portion 64 spaced above the edge portion 66 by the transition portion 68 so that an upper portion of the drive motor unit 12 is disposed within the dished portion of the base plate 62. In addition, as best seen in FIG. 3, portions 70 of the base plate 62 rest on the drive motor unit 12 to support the guard 16.

Referring to FIGS. 1 and 2, the guard 16 is unique in that the vanes 32 are not directly attached to each other by any connection device, except for connection provided by the base plate 62 and the hub 30. In particular, no connection devices extend between the side surfaces 58, 60 of adjacent vanes 32 so the side surfaces of adjacent vanes 32 are not directly attached to each other. In addition, no connection devices extend between the radially outward facing edges 52 of adjacent vanes 32 so the edges 52 are not directly attached to each other. In addition, no connection devices extend between the top edges 54 of adjacent vanes 32 so the edges 54 are not directly attached to each other. The lack of any connection devices between adjacent vanes 32 helps facilitate shedding of weeds and other debris and eliminates locations for weeds and other debris to collect.

Figure 5:
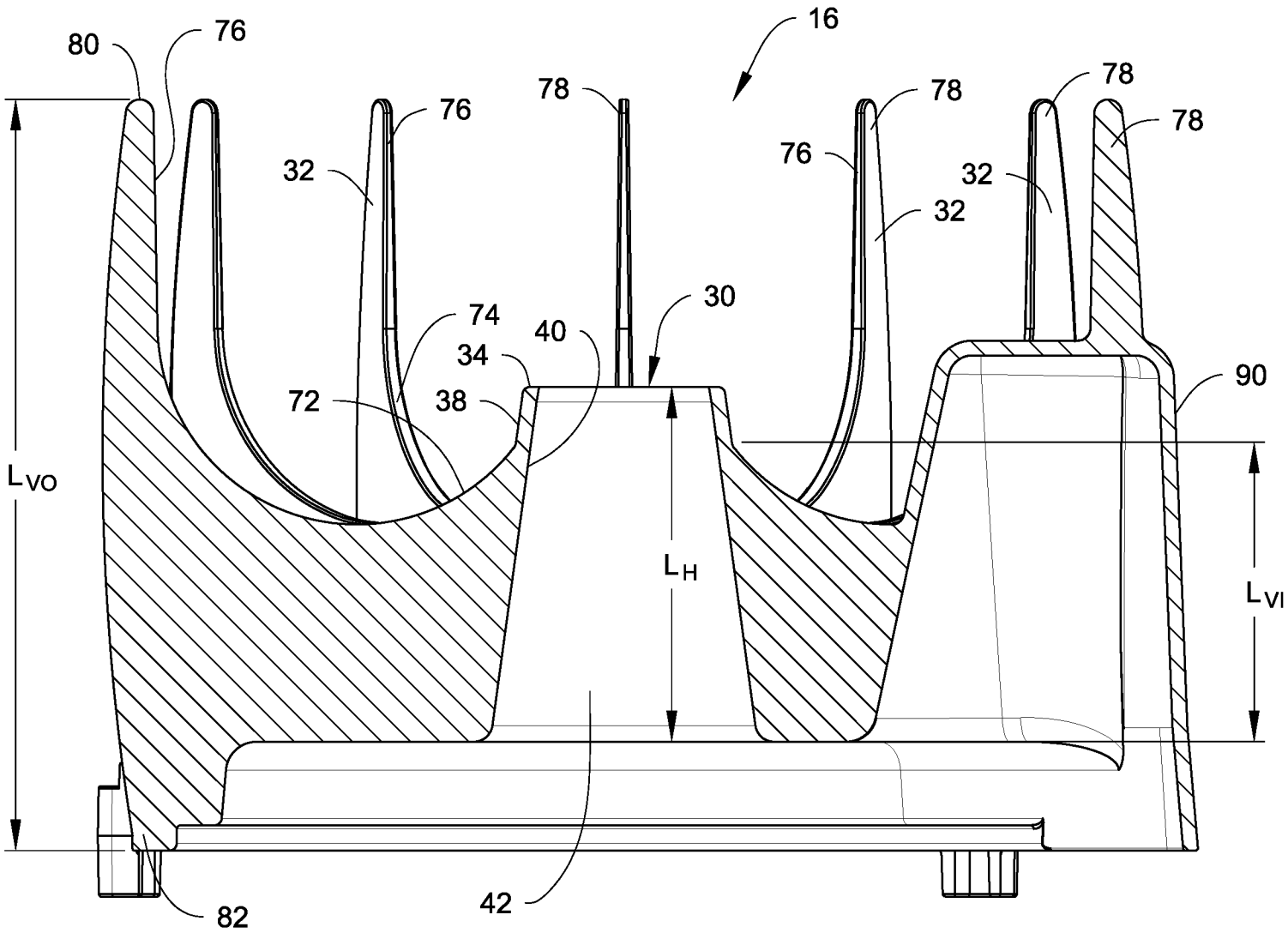
FIG. 5 is a cross-sectional side view of the propeller guard taken along line 5-5 of FIG. 2.

Referring to FIGS. 2, 4 and 5, the top edge 54 of each vane 32 is curved along most of its length. In particular, the top edge 54 includes a portion 72 that curves downwardly from the radially inner end 50 that transitions into a portion 74 that curves upwardly. The portion 74 then transitions into a portion 76 that is substantially linear and that is substantially parallel to the central axis of the hub 30 and parallel to the drive shaft 20. The portion 76 together with the upper portion of the outward facing edge 52 define a relatively narrow tip section, tine or finger 78 on each vane 32.

With continued reference to FIGS. 2, 4 and 5, the radially outward facing edge 52 of each vane 32 is convexly curved radially outwardly. The convex curvature extends from a first junction 80 between the top edge 54 and the radially outward facing edge 52, and a second junction 82 between the bottom 56 and the radially outward facing edge 52. As seen in FIGS. 4 and 5, in a side view, the first junction 80 is longitudinally beyond or above the first end 34 of the center hub 30 and the second junction 82 is longitudinally beyond or below the second end 36 of the center hub 30. Further, each tip section 78 is longitudinally beyond or above the first end 34 of the center hub 30. Accordingly, for each vane 32, a longitudinal length Lvo at the radially outward facing edge 52 is greater than a longitudinal length Lvi at the radially inner end 50. Further, the longitudinal length Lvo at the radially outward facing edge 52 is greater than the longitudinal length LH of the center hub 30 from the first end 34 to the second end 36.

One of the vanes 32 has a configuration different than the other vanes 32. Specifically, one of the vanes 32 is configured to include a power cord housing 90 that can be integrally formed with one of the vanes 32. Referring to FIGS. 1-3 and 5, the power cord housing 90 is a hollow structure formed on one of the vanes 32 with the hollow structure being open at the bottom thereof to accommodate a portion of the power cord 18 and a connection end 92 of the power cord 18 as best seen in FIG. 3. As depicted in FIG. 3, the interior space of the power cord housing 90 is sufficient to permit the power cord 18 to double over on itself when the connection end 92 is plugged into the drive motor unit 12. The doubling over of the power cord 18 in the power cord housing 90 provides stress relief on the power cord 18. Further, the tip section 78 of the vane 32 that includes the power cord housing 90 is disposed at the top of and extends upwardly from the power cord housing 90.

As should be apparent from the above description, the configuration of the vanes 32 of the guard 16 define an area sufficient to receive the propeller 14 therein. The propeller 14 sits in the space and as best seen in FIG. 3, the tip sections 78 surround the propeller 14 and extend a distance above the propeller 14. As the propeller 14 rotates, a flow is created as depicted by the arrows in FIG. 1.

The hub 30, the vanes 32 and the base plate 62 can be an integrally formed one-piece construction of plastic. However, the hub 30, the vanes 32 and the base plate 62 can be formed of materials other than plastic. In addition, the hub 30, the vanes 32 and the base plate 62 need not be an integrally formed one-piece construction. Instead, one or more of the hub 30, the vanes 32 and the base plate 62 can be separately formed and thereafter fixedly attached to the other element(s).

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. An axial flow propeller guard, comprising:

a center hub having a first end, a second end, and an outer surface extending from the first end to the second end;

the center hub extends longitudinally from the first end to the second end;

a plurality of vanes, each vane having a radially inner end attached to the outer surface of the center hub, a radially outward facing edge spaced a distance from the center hub, a top edge, a bottom, a first side surface, a second side surface, an inlet end and an outlet end;

the vanes are circumferentially spaced from each other about the center hub; and at least a portion of the radially outward facing edge of each vane at the outlet end thereof slopes toward a longitudinal axis of the central hub, and the outlet ends of the vanes are not directly attached to one another by connection devices.

2. The axial flow propeller guard of claim 1, further comprising a base plate, and the bottom of each vane is attached to the base plate.

3. An axial flow propeller guard, comprising:

a center hub having a first end, a second end, and an outer surface extending from the first end to the second end;

the center hub extends longitudinally from the first end to the second end;

a plurality of vanes, each vane having a radially inner end attached to the outer surface of the center hub, a radially outward facing edge spaced a distance from the center hub, a top edge, a bottom, a first side surface and a second side surface;

the vanes are circumferentially spaced from each other about the center hub; and the top edge of each vane includes a portion that curves downwardly from the radially inner end and a portion that curves upwardly.

4. The axial flow propeller guard of claim 1, wherein each vane includes a first junction between the top edge and the radially outward facing edge, and a second junction between the bottom and the radially outward facing edge; in a side view, the first junction is longitudinally beyond the first end of the center hub and the second junction is longitudinally beyond the second end of the center hub.

5. The axial flow propeller guard of claim 1, wherein each vane includes a tip section, and the tip sections extend longitudinally beyond the first end of the center hub.

6. An axial flow propeller guard, comprising:

a center hub having a first end, a second end, and an outer surface extending from the first end to the second end;

the center hub extends longitudinally from the first end to the second end;

a plurality of vanes, each vane having a radially inner end attached to the outer surface of the center hub, a radially outward facing edge spaced a distance from the center hub, a top edge, a bottom, a first side surface and a second side surface;

the vanes are circumferentially spaced from each other about the center hub; and a power cord housing integrally formed with one of the vanes.

7. A pump comprising:

a drive motor unit with a rotatable drive shaft;

an axial flow propeller fixed to the rotatable driveshaft, the axial flow propeller includes propeller blades;

an axial flow propeller guard, the axial flow propeller guard includes:

a center hub having a first end, a second end, and an outer surface extending from the first end to the second end;

the center hub extends longitudinally from the first end to the second end;

in a side view from a radial direction of the axial flow propeller, the center hub does not overlap the propeller blades of the axial flow propeller;

a plurality of vanes, portions of the vanes surround the axial flow propeller, each vane having a radially inner end attached to the outer surface of the center hub, a radially outward facing edge spaced a distance from the center hub, a top edge, a bottom, a first side surface and a second side surface;

the vanes are circumferentially spaced from each other about the center hub, and at least a portion of the radially outward facing edge of each vane at an outlet end thereof slopes toward a longitudinal axis of the central hub.

8. An axial flow propeller guard, comprising:

a center hub having a first end, a second end, and an outer surface extending from the first end to the second end;

the center hub extends longitudinally from the first end to the second end;

a plurality of fixed guide vanes extending radially from the center hub, each fixed guide vane having a radially inner end attached to the outer surface of the center hub, a radially outward facing edge spaced a distance from the center hub, a top edge, a bottom, a first side surface and a second side surface;

each vane includes a tip section defined between a portion of the top edge thereof and a portion of the radially outward facing edge thereof, and each one of the tip sections is tapered between the portion of the top edge thereof and the portion of the radially outward facing edge thereof;

the top edge includes a portion that curves downwardly from the radially inner end and the portion that curves downwardly transitions into a portion that curves upwardly;

the vanes are circumferentially spaced from each other about the center hub;

a base plate fixed to the second end of the center hub;

the bottom of each vane is attached to the base plate;

for each vane, a longitudinal length at the radially outward facing edge is greater than a longitudinal length at the radially inner end.

9. The axial flow propeller guard of claim 8, wherein the longitudinal length at the radially outward facing edge is greater than a longitudinal length of the center hub from the first end to the second end.

10. The axial flow propeller guard of claim 8, wherein at least a portion of the radially outward facing edge of each vane slopes toward a longitudinal axis of the center hub.

11. An axial flow propeller guard, comprising:

a center hub having a first end, a second end, and an outer surface extending from the first end to the second end;

the center hub extends longitudinally from the first end to the second end;

a plurality of fixed guide vanes extending radially from the center hub, each fixed guide vane having a radially inner end attached to the outer surface of the center hub, a radially outward facing edge spaced a distance from the center hub, a top edge, a bottom, a first side surface and a second side surface;

the vanes are circumferentially spaced from each other about the center hub;

a base plate fixed to the second end of the center hub;

the bottom of each vane is attached to the base plate;

for each vane, a longitudinal length at the radially outward facing edge is greater than a longitudinal length at the radially inner end;

the top edge of each vane includes a portion that curves downwardly from the radially inner end and a portion that curves upwardly.

12. The axial flow propeller guard of claim 8, wherein each vane includes a first junction between the top edge and the radially outward facing edge, and a second junction between the bottom and the radially outward facing edge; and the longitudinal length at the radially outward facing edge of each vane is measured between the first junction and the second junction.

13. The axial flow propeller guard of claim 8, wherein the tip sections extend longitudinally beyond the first end of the center hub.

14. The axial flow propeller guard of claim 13, wherein the tip sections are not directly attached to one another.

15. An axial flow propeller guard, comprising:

a center hub having a first end, a second end, and an outer surface extending from the first end to the second end;

the center hub extends longitudinally from the first end to the second end;

a plurality of fixed guide vanes extending radially from the center hub, each fixed guide vane having a radially inner end attached to the outer surface of the center hub, a radially outward facing edge spaced a distance from the center hub, a top edge, a bottom, a first side surface and a second side surface;

the vanes are circumferentially spaced from each other about the center hub;

a base plate fixed to the second end of the center hub;

the bottom of each vane is attached to the base plate;

for each vane, a longitudinal length at the radially outward facing edge is greater than a longitudinal length at the radially inner end;

a power cord housing integrally formed with one of the vanes.

16. A pump comprising:

a drive motor unit with a rotatable drive shaft;

an axial flow propeller fixed to the rotatable drive shaft;

the axial flow propeller guard of claim 8, and portions of the vanes radially surround the axial flow propeller.

17. A pump comprising:

a drive motor unit with a rotatable drive shaft;

an axial flow propeller fixed to the rotatable driveshaft, the axial flow propeller includes propeller blades;

an axial flow propeller guard, the axial flow propeller guard includes:

a center hub having a first end, a second end, and an outer surface extending from the first end to the second end;

the center hub is axially spaced from the propeller blades;

the center hub extends longitudinally from the first end to the second end;

a plurality of vanes, portions of the vanes surround the axial flow propeller, each vane having a radially inner end attached to the outer surface of the center hub, a radially outward facing edge spaced a distance from the center hub, a top edge, a bottom, a first side surface and a second side surface;

the vanes are circumferentially spaced from each other about the center hub; and the radially outward facing edge of each vane includes a section that slopes toward a longitudinal axis of the central hub, and the section of the radially outward facing edge that slopes toward the longitudinal axis is radially outward of and surrounds the propeller blades.

* * * * *